US006062525A

United States Patent [19]

Lemire

[11] Patent Number: 6,062,525

[45] Date of Patent: May 16, 2000

[54] PICTURE FRAME HANGER

[76] Inventor: Robert Lemire, P.O. Box 229, Kings Park, N.Y. 11754

[21] Appl. No.: 09/179,372

[22] Filed: Oct. 26, 1998

Related U.S. Application Data

[60] Provisional application No. 60/078,365, Mar. 18, 1998.

[51] Int. Cl.[7] ..... A47G 1/24

[52] U.S. Cl. ..... 248/475.1; 248/476; 248/495

[58] Field of Search ..... 248/475.1, 476, 248/480, 489, 493, 495

[56] References Cited

U.S. PATENT DOCUMENTS

| | | | |
|---|---|---|---|
| 779,433 | 1/1905 | Long | 248/495 |
| 2,697,572 | 12/1954 | Pfankuch | 248/495 |
| 3,251,569 | 5/1966 | Rynearson | 248/493 |
| 4,566,665 | 1/1986 | Rynearson | 248/495 |
| 4,892,284 | 1/1990 | Kelrick | 248/476 |
| 5,069,411 | 12/1991 | Murphy | 248/476 |
| 5,806,826 | 9/1998 | Lemire | 248/476 |

*Primary Examiner*—Anita M. King

[57] ABSTRACT

A device that is hung on a wall and provides for continuously adjusting the vertical and horizontal position of an object that is hung on the device by the use of two screws and two threaded holders. The object is hooked in a serpentine fashion onto the threaded vertical adjusting holder which rides up and down on a vertical screw that is supported by the threaded horizontal adjusting holder such that it is free to rotate on the horizontal adjusting holder. The threaded horizontal adjusting holder rides back and forth on a horizontal screw that is supported by brackets nailed into the wall. The horizontal adjusting holder is also able to move radially away from the wall for easing the attachment and adjustment of the object on the vertical adjusting holder. A screwdriver or wrench is used to turn the screws for positioning the object to the desired location.

5 Claims, 2 Drawing Sheets

PICTURE FRAME HANGER

This application claims priority under 35 USC 119 to prior U.S. provisional application serial No. 60/078,365, filed Mar. 18, 1998.

FIELD OF THE INVENTION

The invention concerns a device that is hung on the wall to support an object hung on it in an adjustable fashion.

BACKGROUND OF THE INVENTION

Known picture hangers in commercial production are not continuously adjustable in both the vertical and horizontal directions. It is useful to be able to have a slim device that can hold a picture in close proximity to the wall that allows the center of the picture to be moved horizontally and vertically to the correct position without having to remove the picture from the hanger while also holding the picture in a manner that reduces the possibility of shifting.

Attaching the picture to the hanger is a "blind" procedure that is accomplished by feel. It is also useful to be able to see the hanger and have the hook be able to come away from the wall when attaching the picture to the hanger.

U.S. Pat. No. 4,892,284 describes a rack and pinion method of horizontally moving a carrier that has a vertically adjustable hook attached to it. This device is not very slim and pushes the picture away from the wall. It is also adjusted only from above the picture by the use of an elongated tool and offers only a simple rigid hook for attaching the picture to the hanger. The embodiments shown and described in this patent, due to their complexity, limitations and expense, are not in production.

SUMMARY OF THE INVENTION

An adjustable device for hanging an object on a wall includes a support structure for attaching the device to a wall and a means for continuously moving the object in two perpendicular directions. A vertically positioned threaded screw for vertical adjustment of the height of the object attached to the threaded vertical adjusting holder operating on this screw is movable horizontally on a threaded horizontal adjusting holder operating on the horizontal screw supported by the brackets nailed into the wall. Thus, adjustments of the horizontal screw adjusts the horizontal position of the vertical screw and the object attached to the threaded vertical adjusting holder operating on that screw; while adjustments of the vertical screw adjusts the vertical position of the threaded vertical adjusting holder operating on that screw, thereby changing the position of the object being held by the threaded vertical adjusting holder. The threaded vertical adjusting holder has raised ears on opposite sides of the vertical screw. These ears, along with the vertical screw, hold the object wire in a serpentine manner. The threading of the wire around the ears and screw provide resistance to the movement of the wire from side to side. This holding of the wire keeps the object from shifting from vibrations or incidental contact.

The position of the threaded carriers may be adjusted by pulling the object away from the wall and using a screwdriver or wrench to turn the screws. The horizontal carrier swings radially away from the wall and affords a user ample space to see and work behind the object.

It is the object of the invention to provide a device for easily attaching, adjusting and holding an object on a wall in a position that may be continuously adjusted both horizontally and vertically without having to use special tools or gaining access over the top of the object.

DETAILED DESCRIPTION OF THE INVENTION

A device for holding an object in a specific location on a wall and adjusting its position includes a means for attaching the device to the wall, a means for continuously moving the object, within certain limits, in both a horizontal and vertical direction, and a means of attaching the object so that it remains stable. When a picture or other object is hung on a wall, it is almost impossible to locate the picture exactly in the right place. The side connections, the length of the support wire/cord, the center of gravity of the picture, and being able to measure and place the wall support in the right place are the items that have to be contended with in hanging a picture. The adjustable device of the invention allows the picture to be moved both horizontally and vertically, continuously so that the picture is not removed during the adjusting and only one set of nail holes need to be made in the wall. The device eases the hanging operation by moving the vertical adjusting holder (that holds the object) radially away from the wall so that it can be seen for attaching the wire/cord to it. The vertical adjusting holder also holds the cord in a serpentine manner such that the wire cannot easily slide through it. The entire device rests flat against the wall and only extends the same distance away from the wall as the traditional J-hooks that may be used in the manufacture of this product.

Figure 1:
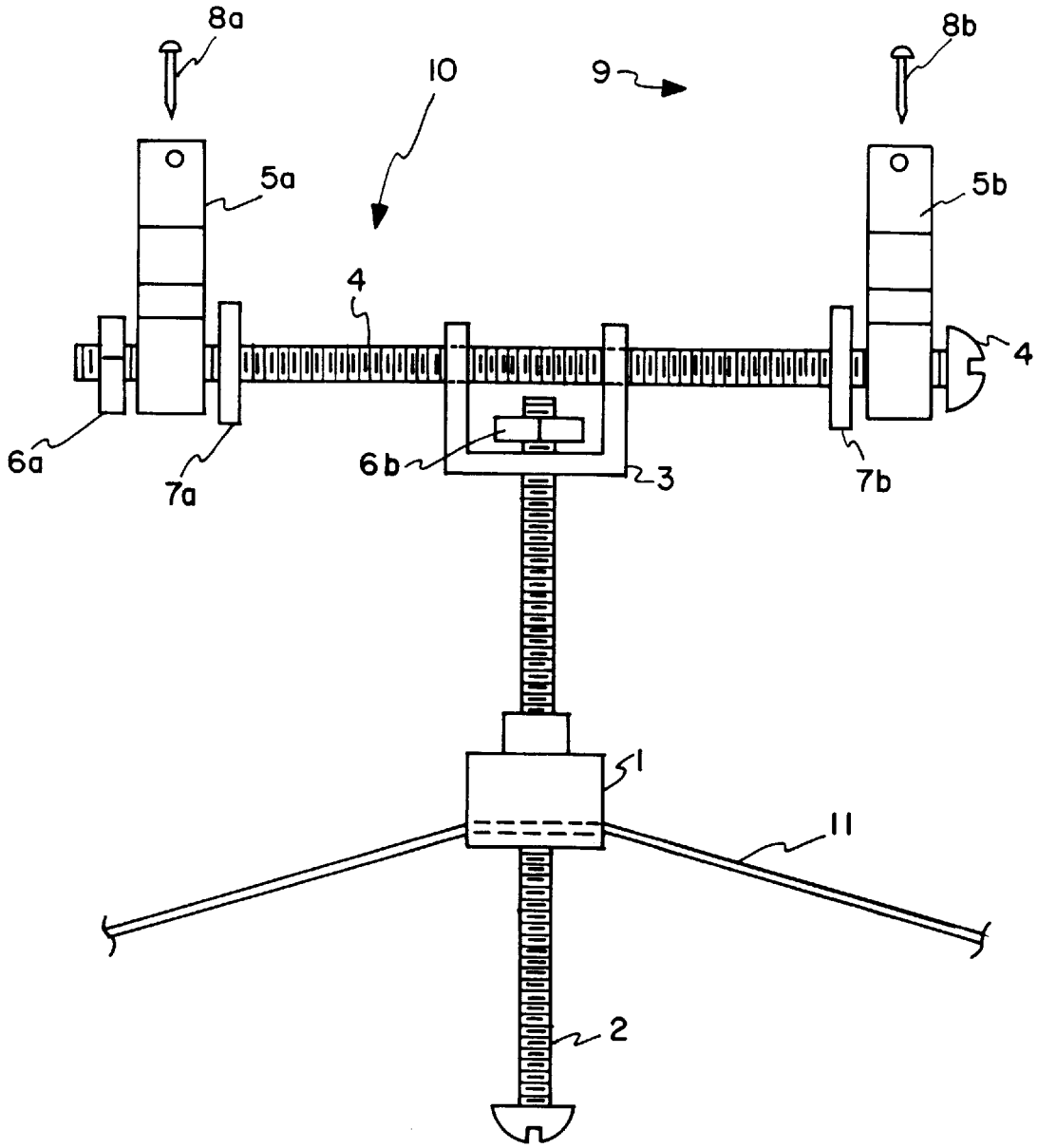
FIG. 1 is a front elevational view of a device of the invention on a wall, in use for hanging an object.
Figure 2:
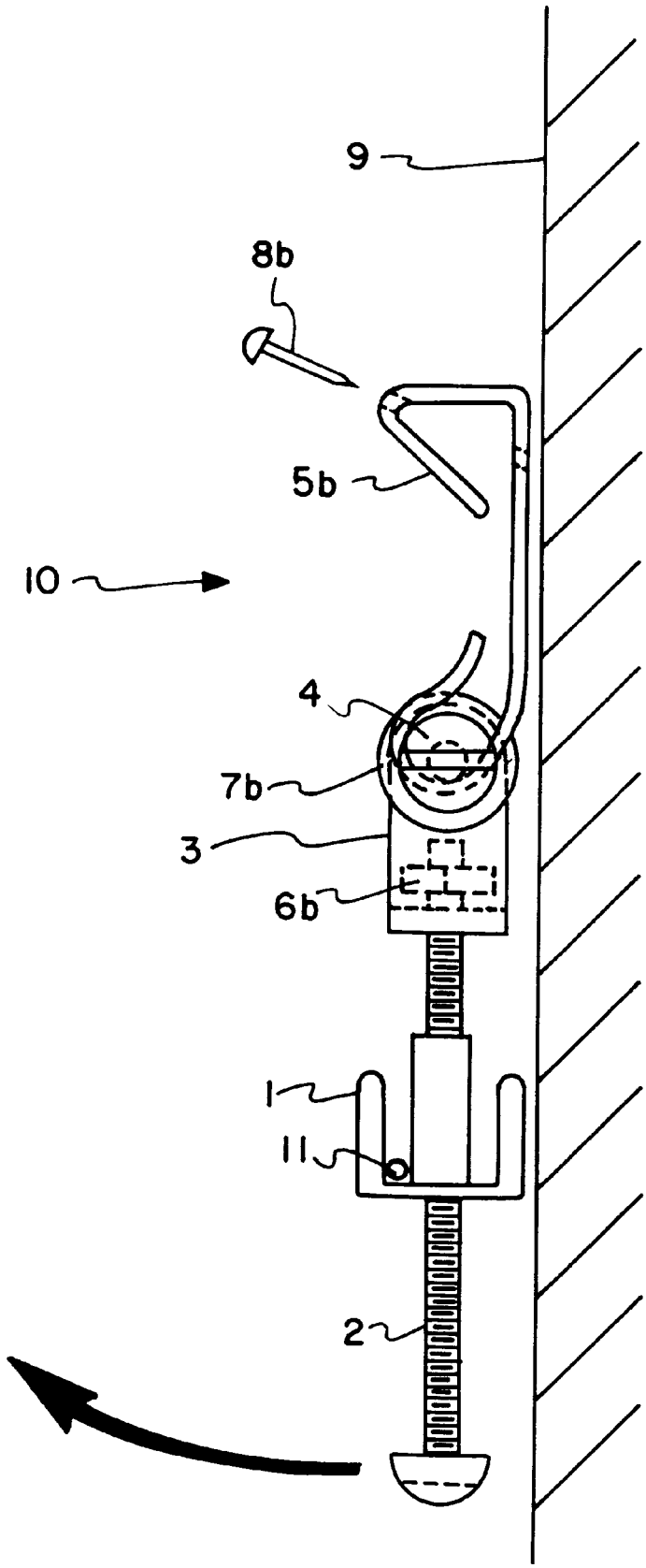
FIG. 2 is a side elevational view of the device of FIG. 1.

With reference to FIGS. 1 & 2, in which like numerals represent like parts, FIGS. 1 & 2 are showing device 10 in position for use, attached to a wall surface 9. Device 10 comprises support 5*a* & 5*b* which are nailed into the wall with the nails 8*a* & 8*b*. Supports 5*a* & 5*b* may be formed from metal J-hooks with top nail holes and bottom hooks bent around and holding the horizontal adjusting screw 4 between them such that it is free to rotate. The supports 5*a* & 5*b* are held in position by retaining washers 7*a* & 7*b* and the end lock-nut 6*a*. The threaded horizontal adjusting holder 3 is in the form of a U-channel with threaded openings on the vertical legs engaged with and ridding on the horizontal adjusting screw 4. The horizontal adjusting holder has an opening in the bottom of the U-channel through which the vertical adjusting screw 2 is secured with lock-nut 6*b* such that the vertical adjusting screw is free to rotate on the inner face of horizontal holder 3. The threaded vertical adjusting holder 1 is engaged with and rides on the vertical adjusting screw 2. The vertical adjusting holder 1 has two vertical legs and engages the object wire/cord 11 such that the wire is behind the outer legs of the vertical holder 1 and in front of the vertical adjusting screw 2. This twisting of the object wire/cord 11 around the vertical adjusting holder 1 keeps the wire from shifting after the object has been aligned on the holder.

In use, device 10 is mounted on wall surface 9 by means of nails 8. Holder 1 is supported by holder 3 and is able to be moved radially away from the wall for the attachment of the object wire 11. To adjust the position of the object a screwdriver or wrench that engages the driving head of the adjusting screws 2 & 4 is used. Turning the vertical adjusting screw 2 causes the vertical holder 1 to rotate up or down the screw. The object wire and the wall prevent the holder 1 from rotating when an object is hung on it and the vertical adjusting screw 2 is turned. Likewise, turning horizontal adjusting screw 4 causes the horizontal adjusting holder 3 to move in a horizontal direction. The wall 9 and the weight of the object keep the holder from rotating on the screw. The adjusting screws are reached by pulling the object away from the wall. This pulling action is accommodated by the horizontal adjusting holder 3 rotating radially away from the wall. Thus the object can be easily hung onto the device and adjusted in both the vertical and horizontal direction.

While the invention has been described above with respect to certain embodiments thereof, it will be appreciated that variations and modifications may be made without departing from the spirit and scope of the invention.

What is claimed is:

1. An adjustable device for hanging an object on a wall, comprising:

means for attachment to said wall;

first adjusting means for continuously moving the object in a horizontal direction engaged with the means for attaching the device to the wall;

holder means for engaging the first adjusting means for continuously moving the object in the horizontal direction such that the holder means may also rotate radially away from the wall;

second adjusting means engaged with the holder means for continuously moving the object in the vertical direction;

means for attaching the object to the device engaged with the second adjusting means; and whereby the object hanging on the device affixed to the wall, may be pulled radially away from the wall for exposing and providing access to the first and second adjusting means which may be used for changing the position of the object without removing the object from the device.

2. A device in claim 1 wherein the first adjusting means for continuously moving the object in the horizontal direction comprises a threaded screw.

3. A device in claim 1 wherein the second adjusting means for continuously moving the object in the vertical direction comprises a threaded screw.

4. A device of claim 1 wherein the holder means comprises a housing threadably engaged with the first adjusting means, engaged with the second adjusting means and dimensioned so that it may be moved horizontally and in a radial arc away form the wall.

5. A device of claim 1 wherein the means for attaching the object to the wall comprises a threaded hook with one or more vertical protrusions for holding the object.

* * * * *